US007223183B2

(12) United States Patent
Sajima

(10) Patent No.: US 7,223,183 B2
(45) Date of Patent: May 29, 2007

(54) GOLF BALL

(75) Inventor: Takahiro Sajima, Kobe (JP)

(73) Assignee: SRI Sports Limited, Hyogo (JP)

( * ) Notice: Subject to any disclaimer, the term of this patent is extended or adjusted under 35 U.S.C. 154(b) by 0 days.

(21) Appl. No.: 11/293,277

(22) Filed: Dec. 5, 2005

(65) Prior Publication Data

US 2006/0142098 A1 Jun. 29, 2006

(30) Foreign Application Priority Data

Dec. 28, 2004 (JP) ..... 2004-378538

(51) Int. Cl.
*A63B 37/12* (2006.01)

(52) U.S. Cl. ..... 473/383

(58) Field of Classification Search ..... 473/383, 473/384

See application file for complete search history.

(56) References Cited

U.S. PATENT DOCUMENTS 5,338,039 A 8/1994 Oka et al.
5,470,076 A * 11/1995 Cadorniga ..... 473/384
6,709,349 B2 * 3/2004 Sullivan ..... 473/383
7,041,013 B2 * 5/2006 Ohama et al. ..... 473/384
7,094,162 B2 * 8/2006 Sajima ..... 473/384
2004/0152541 A1 8/2004 Sajima

FOREIGN PATENT DOCUMENTS

JP 2003-290392 A 10/2003

* cited by examiner

*Primary Examiner*—Raeann Trimiew
(74) *Attorney, Agent, or Firm*—Birch, Stewart, Kolasch & Birch, LLP

(57) ABSTRACT

Two-tiered dimples 8 of a golf ball have a first recessed part X and a second recessed part Y. The first recessed part X substantially forms a part of a spherical shape. The first recessed part X includes a first opening 14, a side wall curved face 16 and a flat face 18. The second recessed part Y is substantially a regular quadrangular pyramid. This second recessed part Y includes a second opening 20, a slope 22 and a bottom face 24. The second opening 20 is a regular tetragon. The first recessed part X improves aerodynamic symmetry of the golf ball. The second recessed part Y improves a dimple effect. Proportion of the number of the two-tiered dimples 8 to total number of the dimples is equal to or greater than 70%.

4 Claims, 12 Drawing Sheets

GOLF BALL

CROSS-REFERENCE TO RELATED APPLICATIONS

This application claims priority on Patent Application No. 2004-378538 filed in JAPAN on Dec. 28, 2004. The entire contents of this Japanese Patent Application are hereby incorporated by reference.

BACKGROUND OF THE INVENTION

1. Field of the Invention

The present invention relates to golf balls. More particularly, the present invention relates to improvements of dimples of golf balls.

2. Description of the Related Art

Golf balls have numerous dimples on the surface thereof. The dimples disrupt the air flow around the golf ball during flight to cause turbulent flow separation. By causing the turbulent flow separation, separating points of the air from the golf ball shift backwards leading to the reduction of drag. The turbulent flow separation promotes the differentia between the separating point on the upper side and the separating point on the lower side of the golf ball, which results from the backspin, thereby enhancing the lift force that acts upon the golf ball. Such a role of the dimples is referred to as a "dimple effect". Excellent dimples disturb the air flow more efficiently.

Polygonal dimples disturb the air flow more efficiently. According to golf balls having polygonal dimples, a great flight distance can be attained. U.S. Pat. No. 5,338,039 discloses a golf ball having dimples with a polygonal plane shape, and with a cross-sectional shape showing a double slope. JP-A-2003-290392 discloses a golf ball having polygonal first dimples and second dimples formed on the bottom face of the first dimple. United States Patent Publication No. 2004/0152541 discloses a golf ball having polygonal dimples arranged thereon using a quasi-regular polyhedron.

Polygonal dimples are inferior in geometrical symmetry compared to circular dimples, therefore, golf balls having the polygonal dimple will be disadvantageous in terms of insufficient aerodynamic symmetry. According to the golf balls that are inferior in aerodynamic symmetry, trajectory may vary depending on the impact point. Golf players can not select the impact point of a golf ball apart from tee shots. Golf balls that are inferior in aerodynamic symmetry yield variation in the flight distance.

An object of the present invention is to provide a golf ball that can attain a great flight distance and is excellent in aerodynamic symmetry.

SUMMARY OF THE INVENTION

A golf ball according to the present invention has numerous dimples on the surface thereof. These dimples include two-tiered dimples. A proportion of the number of the two-tiered dimples to the total number of the dimples is equal to or greater than 70%. This two-tiered dimple has a first recessed part and a second recessed part. This first recessed part comprises a circular first opening positioned on a phantom spherical surface, a side wall curved face positioned on the inside of the first opening, and a flat face positioned on the inside of the side wall curved face. This second recessed part comprises a polygonal second opening positioned on the flat face, a slope positioned on the inside of the second opening, and a bottom face positioned on the inside of the slope.

When the phantom spherical surface is comparted into multiple spherical regular polygons by comparting lines formed through casting a reflection of sides of a regular polyhedron or a quasi-regular polyhedron, which is inscribed in the phantom spherical surface, onto the phantom spherical surface, dimples comprising a second opening having vertices the number of which being equal to the number of vertices of the spherical regular polygon are predominantly formed on each spherical regular polygon.

Preferably, a direction of the axis of symmetry or the comparting line of the spherical regular polygon agrees with the direction of the axis of symmetry of the second opening of the dimple included in the spherical regular polygon.

When the phantom spherical surface is comparted into eight spherical regular triangles and six spherical regular tetragons by comparting lines formed through casting a reflection of sides of a cuboctahedron, which is inscribed in the phantom spherical surface, onto the phantom spherical surface, dimples having a triangular second opening are predominantly formed on the spherical regular triangle. The dimples having a tetragonal second opening are predominantly formed on the spherical regular tetragon.

According to this golf ball, air flow is disrupted by the second recessed part having a polygonal second opening. According to this golf ball, a great flight distance can be attained. Because of the contour of the first recessed part being circular, this dimple does not impair the aerodynamic symmetry.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

The present invention is hereinafter described in detail with appropriate references to the accompanying drawing according to the preferred embodiments of the present invention.

Figure 1:
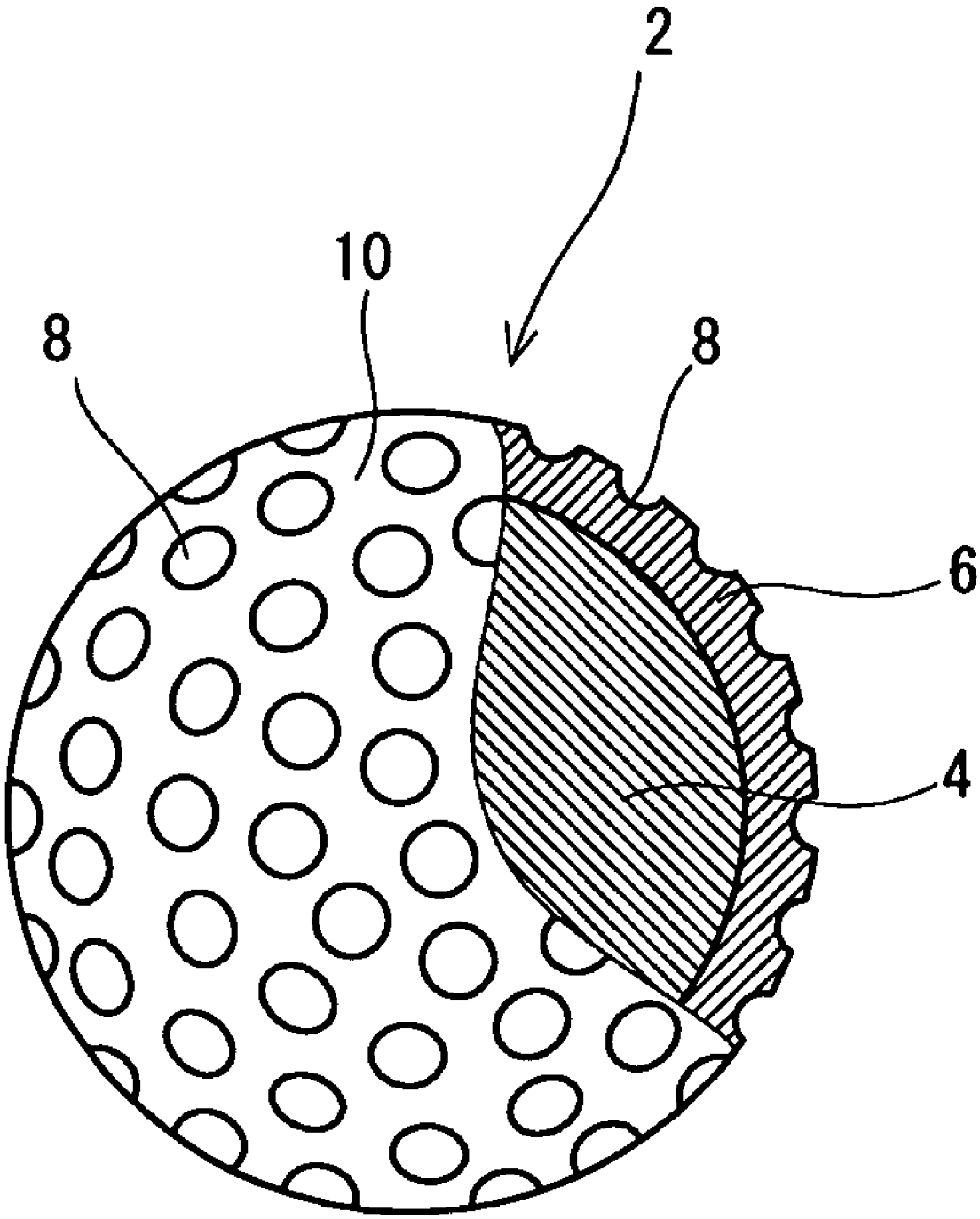
FIG. 1 is a schematic cross-sectional view illustrating a golf ball according to one embodiment of the present invention.

A golf ball 2 illustrated in FIG. 1 has a spherical core 4 and a cover 6. Numerous dimples 8 are formed on the surface of the cover 6. Of the surface of the golf ball 2, a part except for the dimples 8 is a land 10. This golf ball 2 has a paint layer and a mark layer to the external side of the cover 6, although these layers are not shown in the Figure.

This golf ball 2 has a diameter of from 40 mm to 45 mm. From the standpoint of conformity to a rule defined by the United States Golf Association (USGA), the diameter is preferably equal to or greater than 42.67 mm. In light of suppression of the air resistance, the diameter is preferably equal to or less than 44 mm, and more preferably equal to or less than 42.80 mm. The weight of this golf ball 2 is 40 g or greater and 50 g or less. In light of attainment of great inertia, the weight is preferably equal to or greater than 44 g, and particularly preferably equal to or greater than 45.00 g. From the standpoint of conformity to a rule defined by the USGA, the weight is preferably equal to or less than 45.93 g.

The core 4 is formed by crosslinking a rubber composition. Illustrative examples of the base rubber for use in the rubber composition include polybutadienes, polyisoprenes, styrene-butadiene copolymers, ethylene-propylene-diene copolymers and natural rubbers. Two or more kinds of the rubbers may be used in combination. In light of the resilience performance, polybutadienes are preferred, and high cis-polybutadienes are particularly preferred.

For crosslinking of the core 4, a co-crosslinking agent is usually used. Examples of the co-crosslinking agent that is preferable in light of the resilience performance include zinc acrylate, magnesium acrylate, zinc methacrylate and magnesium methacrylate. Into the rubber composition, an organic peroxide may be preferably blended together with the co-crosslinking agent. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide.

Various kinds of additives such as a filler, a sulfur compound, an anti-aging agent, a coloring agent, a plasticizer, a dispersant and the like may be blended in an adequate amount into the rubber composition of the core 4 as needed. Into the rubber composition may be also blended crosslinked rubber powder or synthetic resin powder.

The core 4 has a diameter of equal to or greater than 30.0 mm and particularly equal to or greater than 38.0 mm. The core 4 has a diameter of equal to or less than 42.0 mm and particularly equal to or less than 41.5 mm. The core 4 may be composed of two or more layers.

Polymer which may be suitably used in the cover 6 is an ionomer resin. Particularly, an ionomer resin is suitable which is a copolymer of α-olefin and an α,β-unsaturated carboxylic acid having 3 to 8 carbon atoms in which a part of the carboxylic acid is neutralized with a metal ion. Examples of preferable α-olefin include ethylene and propylene. Examples of preferable α,β-unsaturated carboxylic acid include acrylic acid and methacrylic acid. Illustrative examples of the metal ion for use in neutralization include sodium ion, potassium ion, lithium ion, zinc ion, calcium ion, magnesium ion, aluminum ion and neodymium ion. The neutralization may be carried out with two or more kinds of metal ions. Particularly suitable metal ions in light of the resilience performance and durability of the golf ball 2 are sodium ion, zinc ion, lithium ion and magnesium ion.

Other polymer may be used in place of or together with the ionomer resin. Illustrative examples of the other polymer include thermoplastic styrene elastomers, thermoplastic polyurethane elastomers, thermoplastic polyamide elastomers, thermoplastic polyester elastomers and thermoplastic polyolefin elastomers.

Into the cover 6 may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate amount as needed. The cover 6 may be also blended with powder of a highly dense metal such as tungsten, molybdenum or the like for the purpose of adjusting the specific gravity.

The cover 6 has a thickness of equal to or greater than 0.5 mm, and particularly equal to or greater than 0.8 mm. The cover 6 has a thickness of equal to or less than 2.5 mm, and particularly equal to or less than 2.2 mm. The cover 6 has a specific gravity of equal to or greater than 0.90, and particularly equal to or greater than 0.95. The cover 6 has a specific gravity of equal to or less than 1.10, and particularly equal to or less than 1.05. The cover 6 may be composed of two or more layers.

Figure 2:
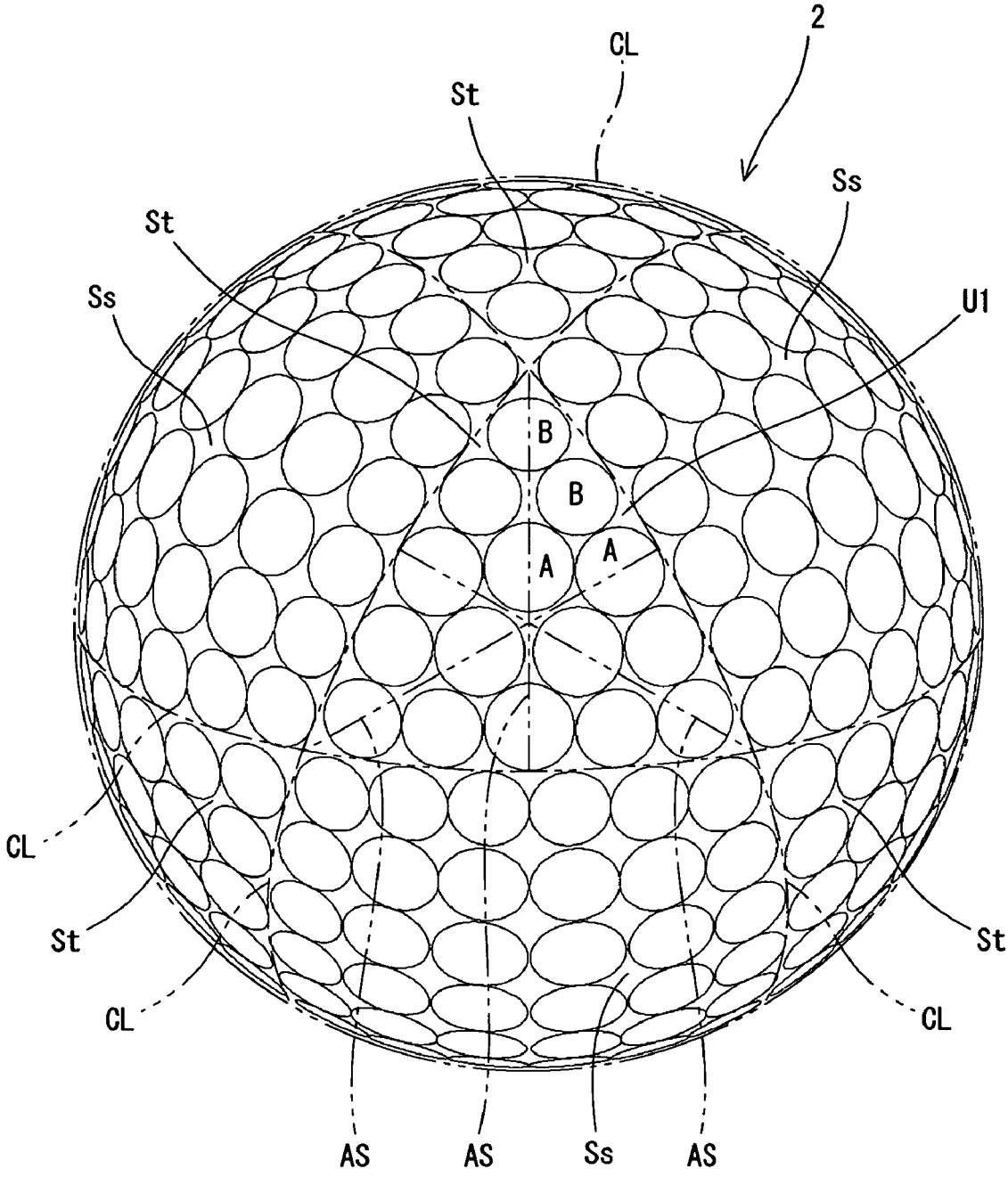
FIG. 2 is an enlarged plan view illustrating the golf ball shown in FIG. 1.
Figure 3:
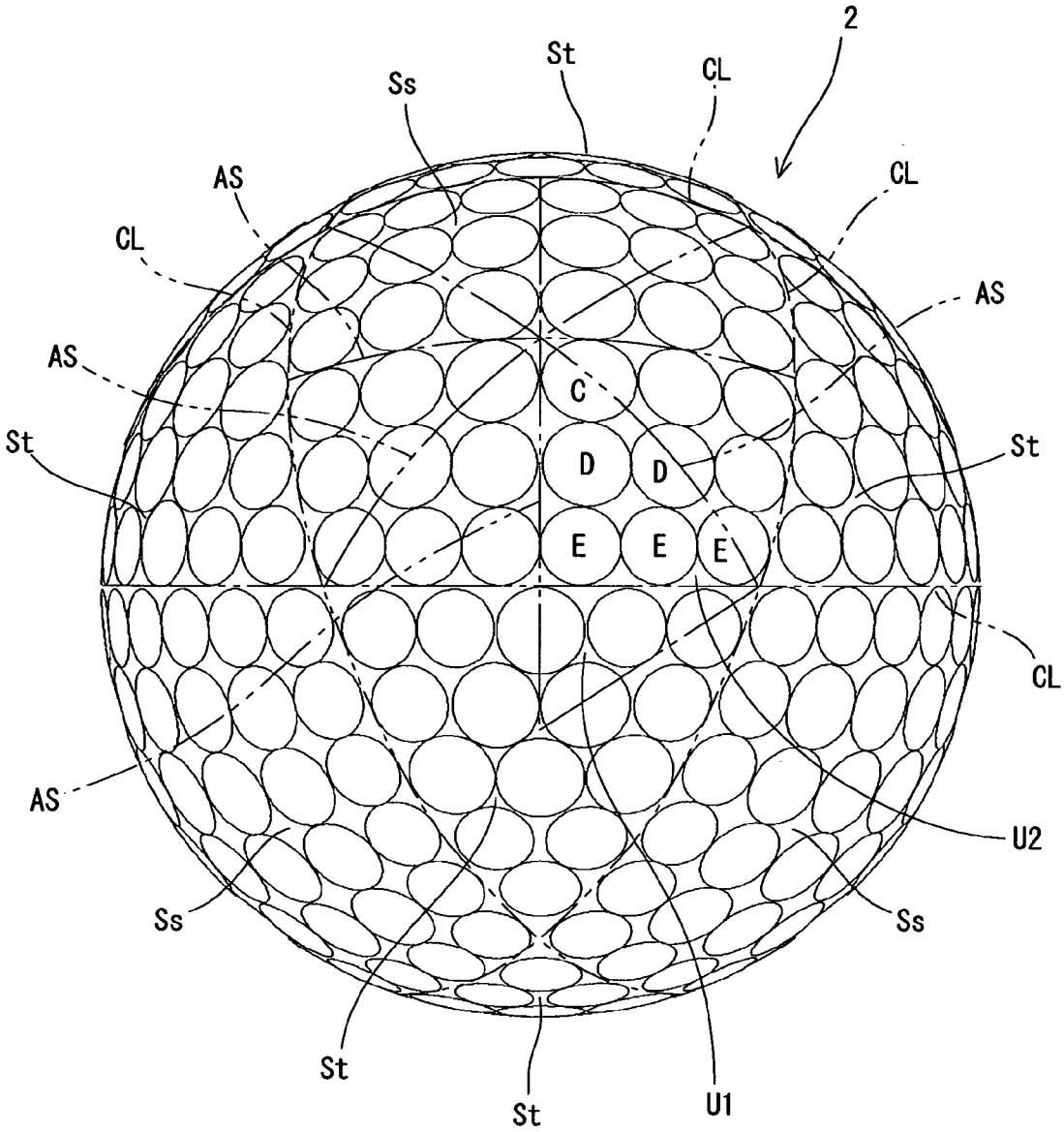
FIG. 3 is a front view illustrating the golf ball shown in FIG. 2.

FIG. 2 is an enlarged plan view illustrating the golf ball 2 shown in FIG. 1; and FIG. 3 is a front view of the same. In this golf ball 2, dimples 8 are arranged using a cuboctahedron. The cuboctahedron is a kind of quasi-regular polyhedron. The cuboctahedron has 14 faces. Among them, eight faces are a regular triangle, and six faces are a regular tetragon. An cuboctahedron inscribed in the phantom spherical surface is envisioned, and the phantom spherical face is comparted into 14 spherical regular polygons by four comparting lines CL obtained through casting a reflection of 24 sides of this cuboctahedron. Dimples 8 are arranged on, all of the spherical regular polygons. The spherical regular polygons consist of two types, i.e., spherical regular triangles St and spherical regular tetragons Ss. In this golf ball 2, there exist eight spherical regular triangles St and six spherical regular tetragons. The term "phantom spherical face" used herein means the surface of the golf ball 2 when it was postulated that there is no dimple 8 existed.

In FIG. 2, what is indicated by a reference sign AS is an axis of symmetry of the spherical regular triangle St. The spherical regular triangle St has three axes of symmetry AS. The spherical regular triangle St can be comparted into six first units U1 by these axes of symmetry AS. The first unit U1 is adjacent to other first unit U1 with the axis of symmetry AS lying therebetween. The first unit U1 has dimples A and dimples B. Dimple pattern of the spherical regular triangle St is obtained by developing the dimple pattern of the first unit U1. The dimples 8 are uniformly arranged on the six first units U1. The dimples 8 are uniformly arranged on the eight spherical regular triangles St. The dimples A and the dimples B are positioned inside of the spherical regular triangle St. The dimple A and the dimple B do not substantially cross with the comparting line CL. The dimple A and the dimple B may cross with the comparting line CL.

What is indicated by the reference sign AS in FIG. 3 is an axis of symmetry of the spherical regular tetragon Ss. The spherical regular tetragon Ss has four axes of symmetry AS. The spherical regular tetragon Ss can be comparted into eight second units U2 by these axes of symmetry AS. The second unit U2 is adjacent to other second unit U2 with the axis of symmetry AS lying therebetween. The second unit U2 is also adjacent to the first unit U1 with the comparting line CL lying therebetween. The second unit U2 has dimples C, dimples D and dimples E. Dimple pattern of the spherical regular tetragon Ss is obtained by developing the dimple pattern of the second unit U2. The dimples 8 are uniformly arranged on the eight second units U2. The dimples 8 are uniformly arranged on the six spherical regular tetragons Ss. The dimples C, the dimples D and the dimples E are positioned inside of the spherical regular tetragon Ss. The dimple C, the dimple D and the dimple E do not substantially cross with the comparting line CL. The dimple C, the dimple D and the dimple E may cross with the comparting line CL.

As is clear from FIG. 2 and FIG. 3, the contour of the dimples A to E is circular. The dimple A has a diameter of 4.30 mm. The dimple B has a diameter of 3.90 mm. The dimple C has a diameter of 4.53 mm. The dimple D has a diameter of 4.30 mm. The dimple E has a diameter of 3.90 mm.

This golf ball 2 has 48 dimples A, 72 dimples B, 24 dimples C, 72 dimples D and 120 dimples E. Total number of the dimples 8 is 336.

Figure 4:
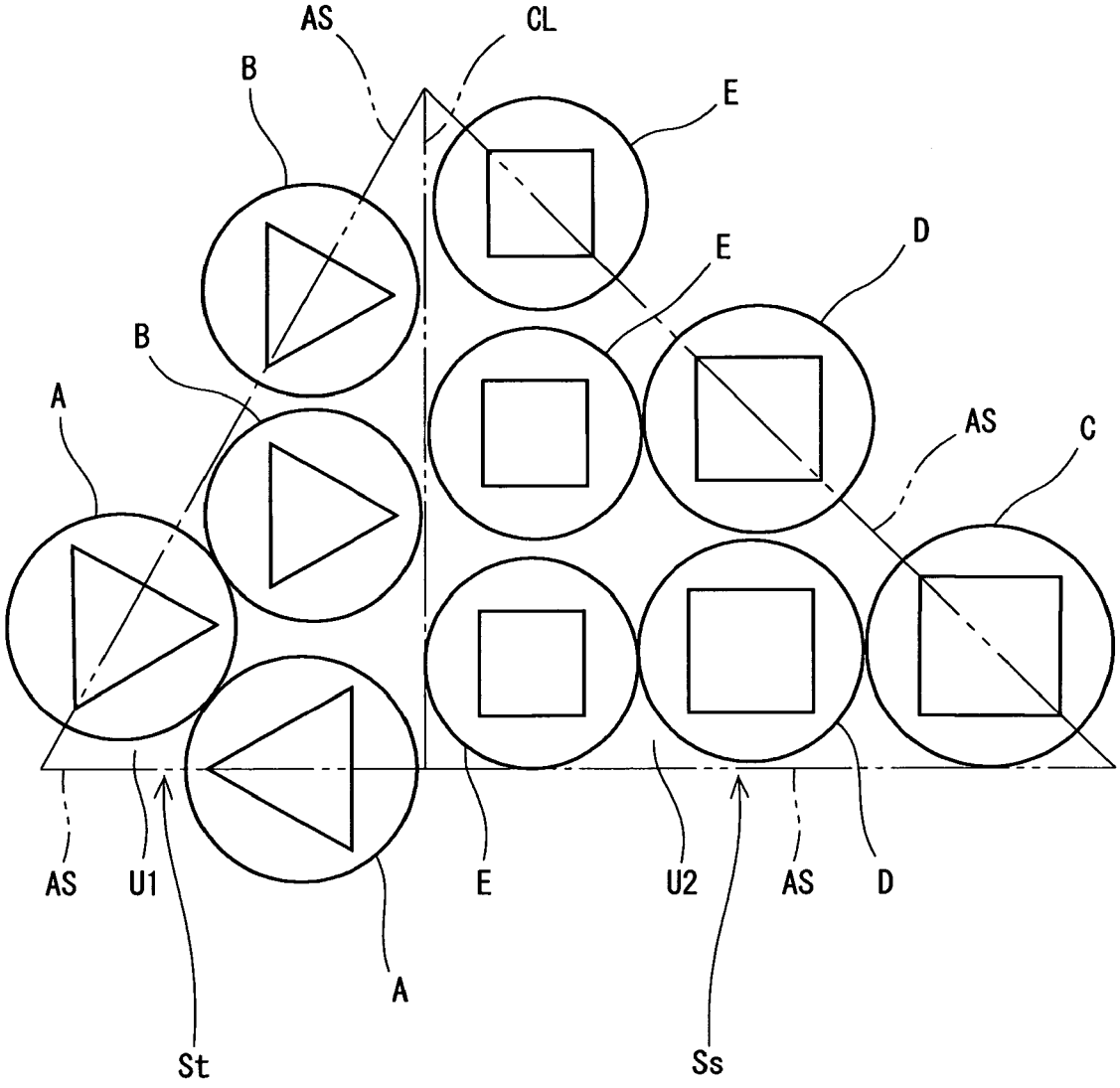
FIG. 4 is a development view illustrating a part of the golf ball shown in FIG. 2.

FIG. 4 is a development view illustrating a part of the golf ball 2 shown in FIG. 2. This FIG. 4 shows the first unit U1 and the second unit U2. This FIG. 4 also shows edges inside of the dimples 8. As is clear from FIG. 4, the dimple A and the dimple B have a regular triangular edge therein. The dimple C, the dimple D and the dimple E have a regular tetragonal edge therein.

Figure 5:
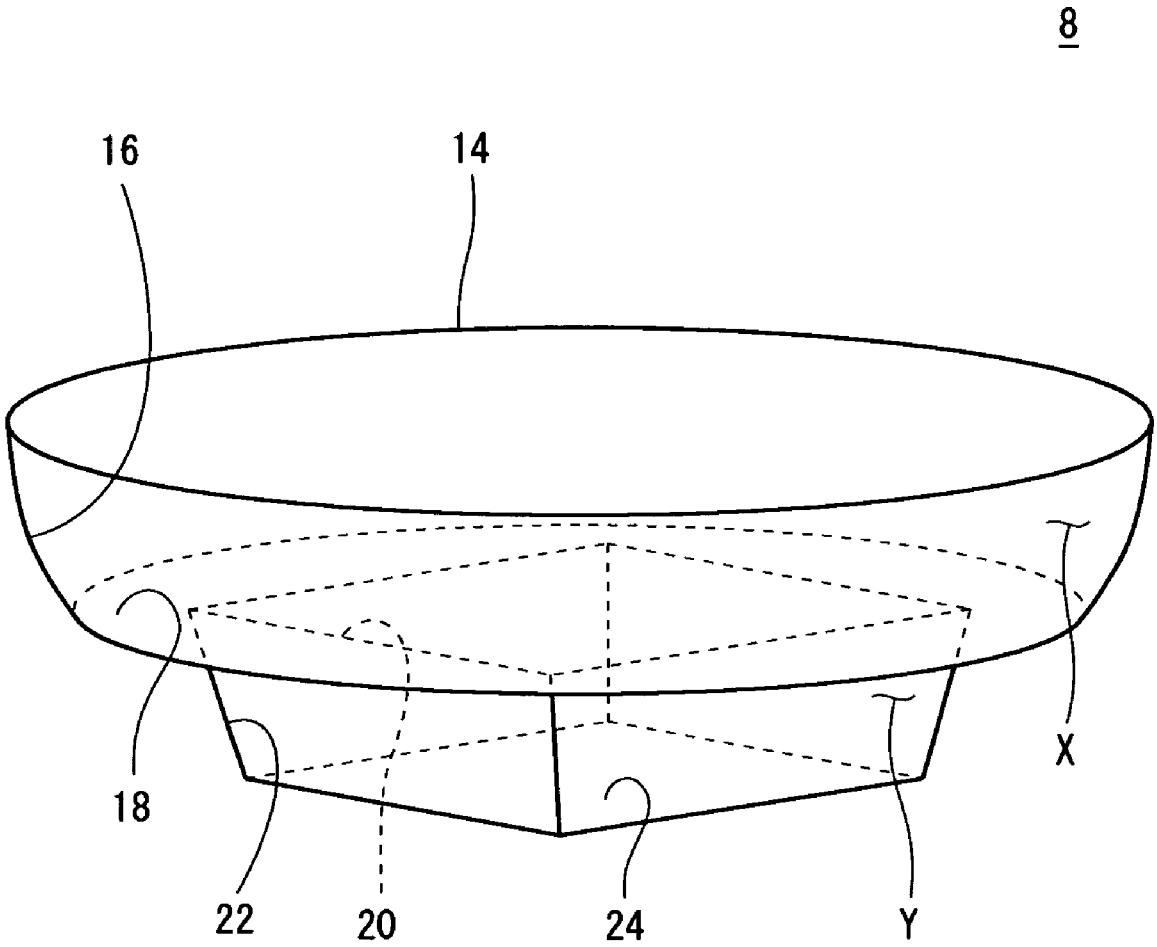
FIG. 5 is an enlarged perspective view illustrating a dimple of the golf ball shown in FIG. 4.
Figure 6:
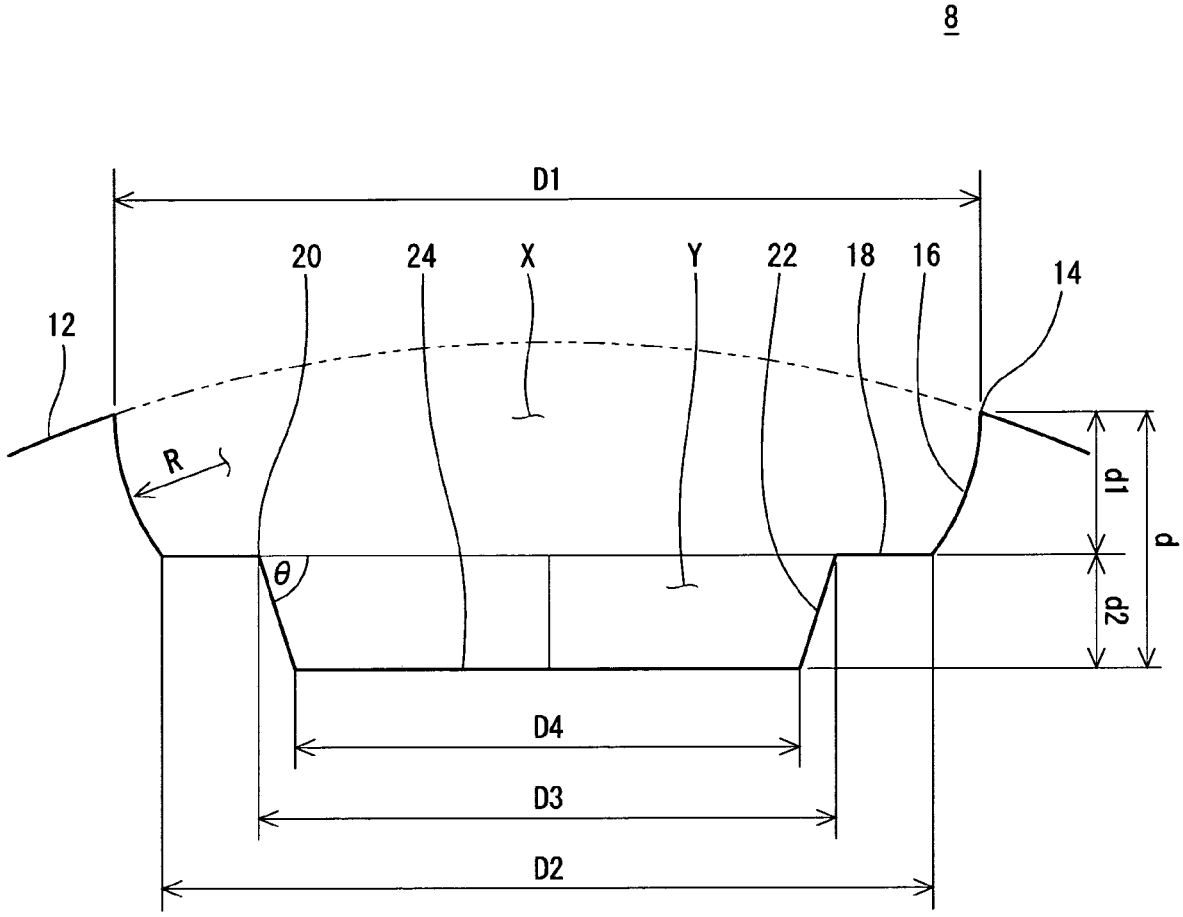
FIG. 6 is a cross sectional view illustrating the dimple shown in FIG. 5.

FIG. 5 is an enlarged perspective view illustrating the dimple 8 (specifically, dimple C) of the golf ball 2 shown in FIG. 4; and FIG. 6 is a cross sectional view of the same. What is indicated by a chain double-dashed line 12 in FIG. 6 is a phantom spherical surface. The dimple 8 is recessed from the phantom spherical surface 12. The land 10 agrees with the phantom spherical surface 12. This dimple 8 has a first recessed part X and a second recessed part Y.

The first recessed part X substantially forms a part of a spherical shape. The first recessed part X comprises a first opening 14, a side wall curved face 16 and a flat face 18. The first opening 14 is positioned on the phantom spherical surface 12. The first opening 14 is circular. The side wall curved face 16 is positioned on the inside of the first opening 14. The side wall curved face 16 has a cross-sectional shape of a circular arc. What is indicated by a reference sign R in FIG. 6 is a curvature radius of the side wall curved face 16. The flat face 18 is positioned on the inside of the side wall curved face 16, and is connected to the side wall curved face 16. Contour of the flat face 18 is circular. Boundary between the side wall curved face 16 and the flat face 18 may be rounded.

The second recessed part Y is substantially a regular quadrangular pyramid. This second recessed part Y comprises a second opening 20, a slope 22 and a bottom face 24. The second opening 20 is positioned on the flat face 18. The second opening 20 is a regular tetragon. The slope 22 is positioned on the inside of the second opening 20. The bottom face 24 is positioned on the inside of the slope 22, and is connected to the slope 22. The bottom face 24 is flat. Contour of the bottom face 24 is a regular tetragon. Boundary between the slope 22 and the bottom face 24 may be rounded.

Although not shown in the Figure, the dimple D and the dimple E also has a first recessed part X forming a part of a spherical shape and a second recessed part Y that is a regular quadrangular pyramid, similarly to the dimple C. Although not shown in the Figure, the dimple A and the dimple B have a first recessed part X forming a part of a spherical shape, and a second recessed part Y that is a regular triangular pyramid. In the present invention, the dimple 8 having a first recessed part X and a second recessed part Y that is a polyangular pyramid is referred to as a two-tiered dimple.

In this two-tiered dimple 8, the air flows along the side wall curved face 16 into the first recessed part X. The air further flows along the flat face 18 and one slope 22 into the second recessed part Y, then hits the opposite slope 22. This hitting disrupts the air flow. Because the second opening 20 is a polygon, the flow is disrupted to a great extent. The two-tiered dimple 8 exerts a dimple effect that is comparable to conventional polygonal dimples. Because the two-tiered dimple 8 has a circular first opening 14, less variation of the dimple effect depending on the direction of the air flow may be caused. The two-tiered dimple 8 is more excellent in the aerodynamic symmetry compared to conventional polygonal dimples. The two-tiered dimple 8 permits to attain a greater flight distance and excellent symmetry.

The golf ball 2 may have other dimples in addition to the two-tiered dimple 8. Examples of the other dimples include single radius dimples, double radius dimples and the like. In light of the flight performance, proportion P1 of the number of the two-tiered dimples 8 to total number of the dimples is preferably equal to or greater than 70%, more preferably equal to or greater than 75%, and particularly preferably equal to or greater than 85%. Ideally, the proportion P1 is 100%. The golf ball 2 shown in FIG. 2 to FIG. 4 has 120 two-tiered dimples 8 having a second recessed part Y that is a regular triangular pyramid, and 216 two-tiered dimples 8 having a second recessed part Y that is a regular quadrangular pyramid. In this golf ball 2, the proportion P1 is 100%.

In light of the symmetry, it is preferred that the shape of the second opening 20 be a regular polygon. In light of the dimple effect, the number of vertices of the polygon of the second opening 20 is preferably equal to or less than 8, and particularly preferably equal to or less than 6. Preferably, the second opening 20 is a regular triangle, a regular tetragon, a regular pentagon and a regular hexagon.

In light of the appearance of the golf ball 2, it is preferred that in the spherical regular polygon are arranged the dimples 8 comprising the second opening 20 having the number of vertices that is equal to the number of vertices of this spherical regular polygon. Proportion P2 of the number of the dimples 8 comprising the second opening 20 having the number of vertices that is equal to the number of vertices of the spherical regular polygon to the number of the dimples in the spherical regular polygon is preferably equal to or greater than 50%, and more preferably equal to or greater than 70%. In the golf ball 2 shown in FIG. 2 to FIG. 4, all the dimples 8 present in the spherical regular triangle St have a regular triangular second opening 20. In this spherical regular triangle St, the proportion P2 is 100%. In this golf ball 2, all the dimples 8 present in the spherical regular tetragon Ss have a regular tetragonal second opening 20. In this spherical regular tetragon Ss, the proportion P2 is 100%.

As is clear from FIG. 4, in this golf ball 2, the axis of symmetry of the second opening 20 is parallel to the closest line among the axes of symmetry AS of the spherical regular polygon and the comparting line CL. This dimple 8 is responsible for appearance of the golf ball 2. This dimple 8 is also responsible for aerodynamic symmetry of the golf ball 2.

What is indicated by a both-oriented arrowhead D1 in FIG. 6 is the size of the first opening 14; what is indicated by a both-oriented arrowhead D2 is the size of the flat face 18; what is indicated by a both-oriented arrowhead D3 is the size of the second opening 20; and what is indicated by a both-oriented arrowhead D4 is the size of the bottom face 24. Size D1 of the first opening 14 is the diameter of the dimple 8. Size D2 of the flat face 18 is the diameter of the flat face 18. Size D3 of the second opening 20 is the diameter of the minimal circle including the second opening 20 therein. Size D4 of the bottom face 24 is the diameter of the minimal circle including the bottom face 24 therein.

The size D1 of the first opening 14 is preferably 2.0 mm or greater and 6.0 mm or less. By setting the size D1 to be equal to or greater than 2.0 mm, an excellent dimple effect may be achieved. In this respect, the size D1 is more preferably equal to or greater than 2.2 mm, and particularly preferably equal to or greater than 2.4 mm. By setting the size D1 to be equal to or less than 6.0 mm, a feature of the golf ball 2 which is substantially a sphere may be retained. In this respect, the size D1 is more preferably equal to or less than 5.8 mm, and particularly preferably equal to or less than 5.6 mm.

Ratio (D3/D1) of the size D3 of the second opening 20 to the size D1 of the first opening 14 is preferably 0.30 or greater and 0.75 or less. By setting the ratio (D3/D1) to be equal to or greater than 0.30, the second recessed part Y may sufficiently contribute to the dimple effect, thereby attaining a great flight distance. In this respect, the ratio (D3/D1) is more preferably equal to or greater than 0.35, and particularly preferably equal to or greater than 0.40. By setting the ratio (D3/D1) to be equal to or less than 0.75, the first recessed part X may sufficiently contribute to the dimple effect, thereby attaining excellent aerodynamic symmetry. In this respect, the ratio (D3/D1) is more preferably equal to or less than 0.70, and particularly preferably equal to or less than 0.65.

Ratio (D2/D1) of the size D2 of the flat face 18 to the size D1 of the first opening 14 is preferably 0.45 or greater and 0.85 or less. By setting the ratio (D2/D1) to be equal to or greater than 0.45, a great flight distance may be attained. In this respect, the ratio (D2/D1) is more preferably equal to or greater than 0.50, and particularly preferably equal to or greater than 0.55. By setting the ratio (D2/D1) to be equal to or less than 0.85, excellent aerodynamic symmetry may be attained. In this respect, the ratio (D2/D1) is more preferably equal to or less than 0.80, and particularly preferably equal to or less than 0.75.

Ratio (D3/D2) of the size D3 of the second opening 20 to the size D2 of the flat face 18 is preferably equal to or greater than 0.75. By setting the ratio (D3/D2) to be equal to or greater than 0.75, a great flight distance may be attained. In this respect, the ratio (D3/D2) is more preferably equal to or greater than 0.80, and particularly preferably equal to or greater than 0.85. The ratio (D3/D2) is equal to or less than 1.00.

What is indicated by a both-oriented arrowhead d in FIG. 6 is the depth of the dimple 8; what is indicated by a both-oriented arrowhead d1 is the depth of the first recessed part X; and what is indicated by a both-oriented arrowhead d2 is the depth of the second recessed part Y. Sum total of the depth d1 and the depth d2 is the depth d.

The depth d is preferably 0.10 mm or greater and 0.25 mm or less. By setting the depth d to be equal to or greater than 0.10 mm, hopping of the golf ball 2 may be suppressed. In this respect, the depth d is more preferably equal to or greater than 0.11 mm, and particularly preferably equal to or greater than 0.15 mm. By setting the depth d to be equal to or less than 0.25 mm, dropping of the golf ball 2 may be suppressed. In this respect, the depth d is more preferably equal to or less than 0.24 mm, and particularly preferably equal to or less than 0.20 mm.

Ratio (d2/d1) of the depth d2 of the second recessed part Y to the depth d1 of the first recessed part X is preferably 0.65 or greater and 1.65 or less. By setting the ratio (d2/d1) to be equal to or greater than 0.65, the second recessed part Y may sufficiently contribute to the dimple effect, thereby attaining a great flight distance. In this respect, the ratio (d2/d1) is more preferably equal to or greater than 0.75, and particularly preferably equal to or greater than 0.80. By setting the ratio (d2/d1) to be equal to or less than 1.65, the first recessed part X may sufficiently contribute to the dimple effect, thereby attaining excellent aerodynamic symmetry. In this respect, the ratio (d2/d1) is more preferably equal to or less than 1.55, and particularly preferably equal to or less than 1.50.

What is indicated by a reference sign θ in FIG. 6 is an angle of a slope 22 with respect to the horizontal direction. The angle θ is preferably 30° or greater and 85° or less. By setting the angle θ to be equal to or greater than 30°, the second recessed part Y may sufficiently contribute to the dimple effect, thereby attaining a great flight distance. In this respect, the angle θ is more preferably equal to or greater than 35°, and particularly preferably equal to or greater than 40°. By setting the angle θ to be equal to or less than 85°, the golf ball 2 can be readily released when it is molded. In this respect, the angle θ is more preferably equal to or less than 80°, and particularly preferably equal to or less than 75°.

According to the present invention, a ratio of the total area of all the dimples 8 to the area of the phantom spherical surface 12 is referred to as an occupation ratio. From the standpoint that a sufficient dimple effect may be achieved, the occupation ratio is preferably equal to or greater than 70%, more preferably equal to or greater than 72%, and particularly preferably equal to or greater than 74%. The occupation ratio is preferably equal to or less than 90%. In the golf ball 2 shown in FIG. 2 and FIG. 3, total area of the dimples 8 is 4423.1 $mm^2$. Because the area of the phantom spherical surface 12 of this golf ball 2 is 5728 $mm^2$, the occupation ratio is 77.2%.

According to the present invention, volume v of the dimple 8 means a volume of a part surrounded by a plane including the first opening 14, and the surface of the dimple 8. The volume v is sum total of the volume v1 of the first recessed part X and the volume v2 of the second recessed part Y. It is preferred that total volume of the dimples 8 is 250 $mm^3$ or greater and 400 $mm^3$ or less. By setting the total volume to be equal to or greater than 250 $mm^3$, hopping of the golf ball 2 may be suppressed. In this respect, the total volume is more preferably equal to or greater than 260 $mm^3$, and particularly preferably equal to or greater than 270 $mm^3$. By setting the total volume to be equal to or less than 400 $mm^3$, dropping of the golf ball 2 may be suppressed. In this respect, the total volume is more preferably equal to or less than 390 $mm^3$, and particularly preferably equal to or less than 380 $mm^3$.

It is preferred that total number of the dimples 8 is 200 or greater and 500 or less. By setting the total number to be equal to or greater than 200, satisfactory aerodynamic characteristic may be achieved. In this respect, the total number is more preferably equal to or greater than 240, and particularly preferably equal to or greater than 260. By setting the total number to be equal to or less than 500, dimples 8 having an appropriate size can be formed. Due to the dimple 8 having an appropriate size, an excellent dimple effect may be achieved. In this respect, the total number is more preferably equal to or less than 480, and particularly preferably equal to or less than 460.

The dimples 8 may be arranged using a quasi-regular polyhedron other than the cuboctahedron. Illustrative examples of the other quasi-regular polyhedron include icosidodecahedrons. The dimples 8 may be arranged also using a regular polyhedron. Illustrative examples of preferable regular polyhedron include regular hexahedrons, regular octahedrons, regular dodecahedrons and regular icosahedrons. The quasi-regular polyhedron and the regular polyhedron are excellent in geometrical symmetry. Due to a synergistic effect of the quasi-regular polyhedron or the regular polyhedron and the two-tiered dimple 8, excellent aerodynamic symmetry may be attained.

Figure 7:
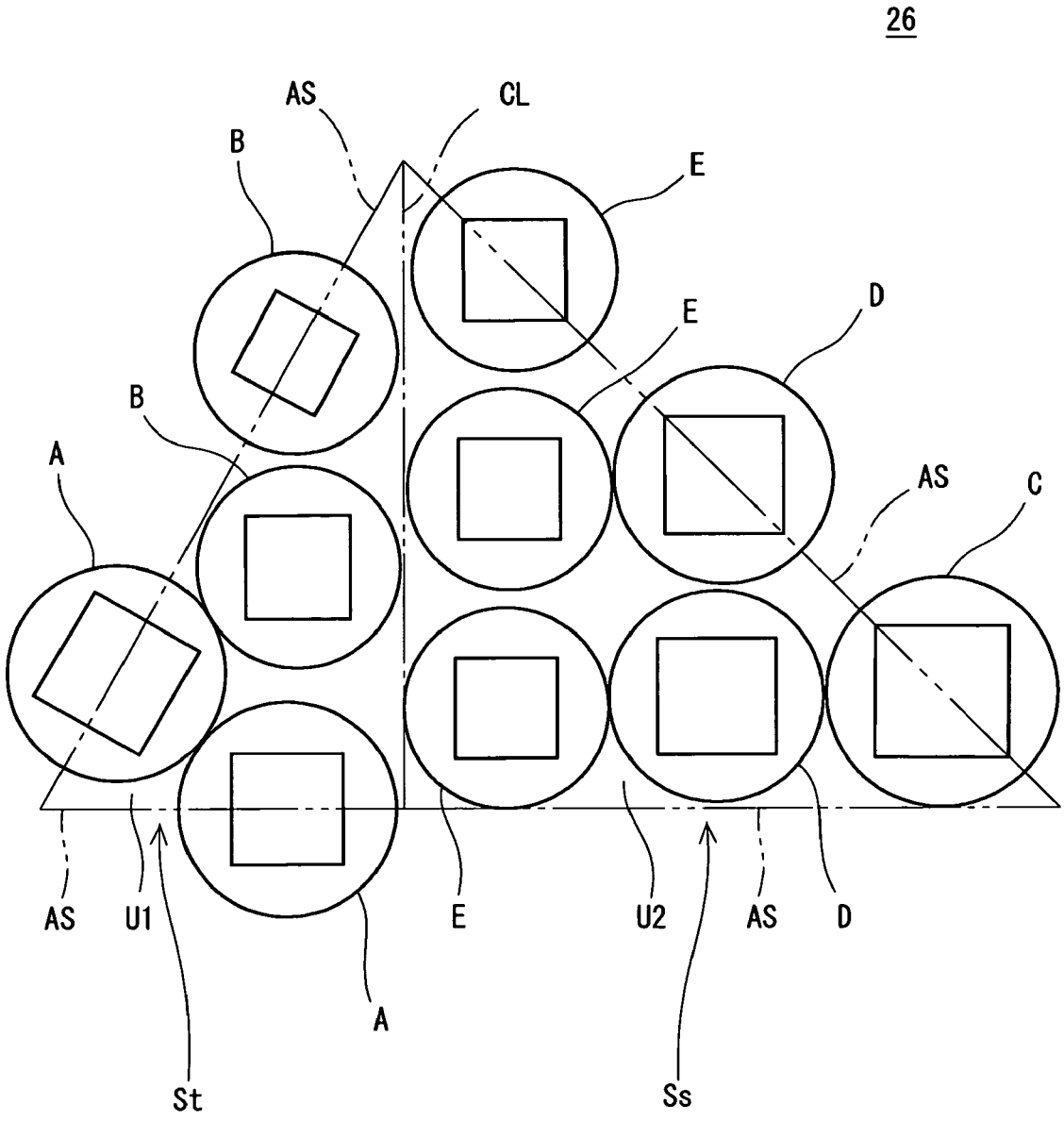
FIG. 7 is a development view illustrating a part of a golf ball according to another embodiment of the present invention.

FIG. 7 is a development view illustrating a part of a golf ball 26 according to another embodiment of the present invention. Also in this golf ball 26, dimples are arranged using a cuboctahedron similarly to the golf ball 2 shown in FIG. 2 and FIG. 3. Surface of the golf ball 26 is comparted into eight spherical regular triangles St and six spherical regular tetragons Ss by comparting lines CL. The spherical regular triangle St is comparted into six first units U1 by axes of symmetry AS. The spherical regular tetragon Ss is comparted into eight second units U2 by axes of symmetry AS. FIG. 7 shows one first unit U1 and one second unit U2.

The first unit U1 has dimples A and dimples B. The second unit U2 has dimples C, dimples D and dimples E. Any one of the dimples A to E is a two-tiered dimple having a first recessed part X (not shown in the Figure) and a second recessed part Y. Any one of the dimples A to E has a regular tetragonal second opening. In other words, the second recessed part Y is a regular quadrangular pyramid. According to this golf ball 26, a great flight distance and excellent aerodynamic symmetry may be attained due to the two-tiered dimples.

Figure 8:
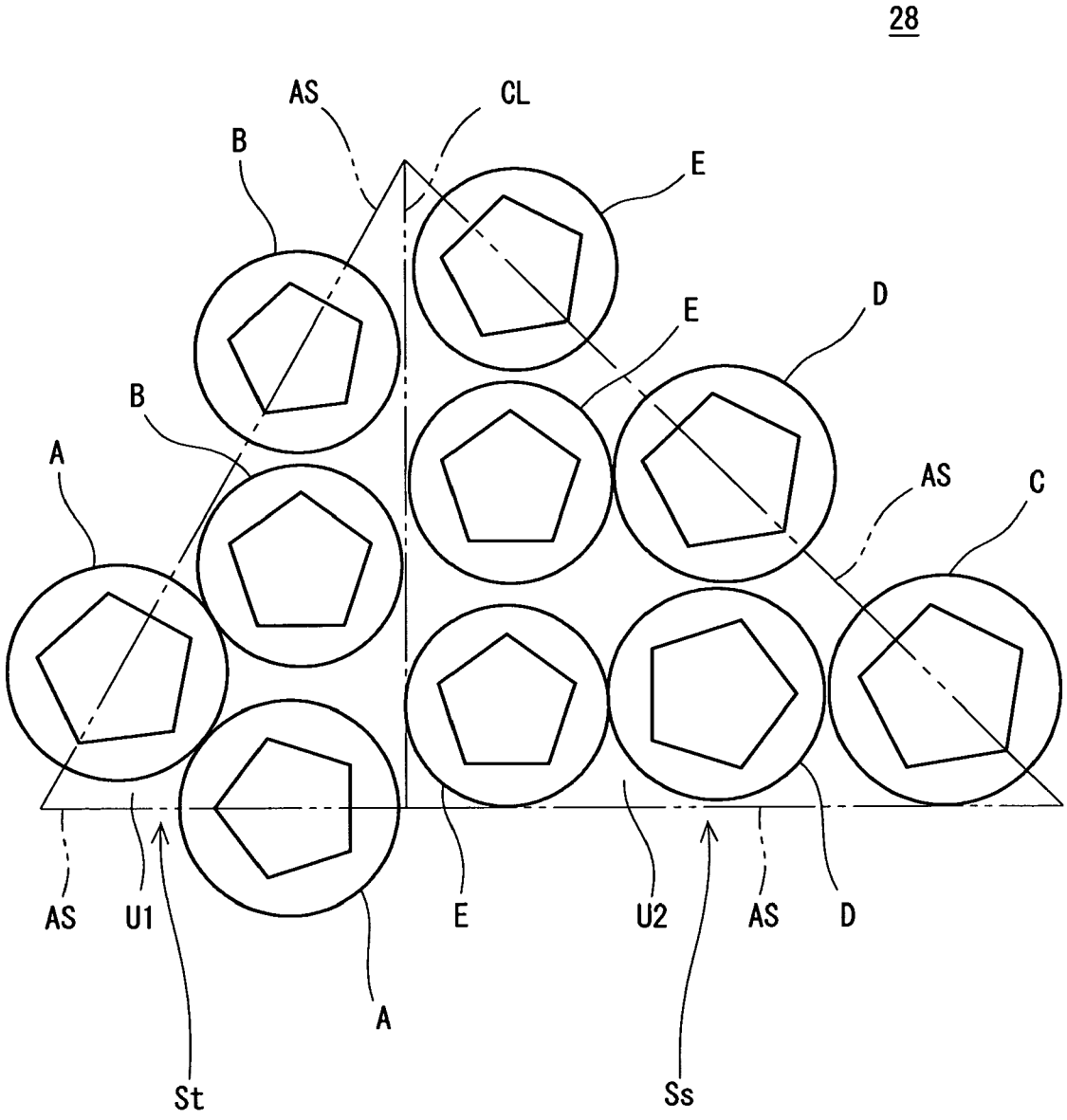
FIG. 8 is a development view illustrating a part of a golf ball according to still another embodiment of the present invention.

FIG. 8 is a development view illustrating a part of a golf ball 28 according to still another embodiment of the present invention. Also in this golf ball 28, dimples are arranged using a cuboctahedron similarly to the golf ball 2 shown in FIG. 2 and FIG. 3. Surface of the golf ball 28 is comparted into eight spherical regular triangles St and six spherical regular tetragons Ss by comparting lines CL. The spherical regular triangle St is comparted into six first units U1 by axes of symmetry AS. The spherical regular tetragon Ss is comparted into eight second units U2 by axes of symmetry AS. FIG. 8 shows one first unit U1 and one second unit U2.

The first unit U1 has dimples A and dimples B. The second unit U2 has dimples C, dimples D and dimples E. Any one of the dimples A to E is a two-tiered dimple having a first recessed part X (not shown in the Figure) and a second recessed part Y. Any one of the dimples A to E has a regular pentagonal second opening. In other words, the second recessed part Y is a regular pentangular pyramid. According to this golf ball 28, a great flight distance and excellent aerodynamic symmetry may be attained due to the two-tiered dimples.

Figure 9:
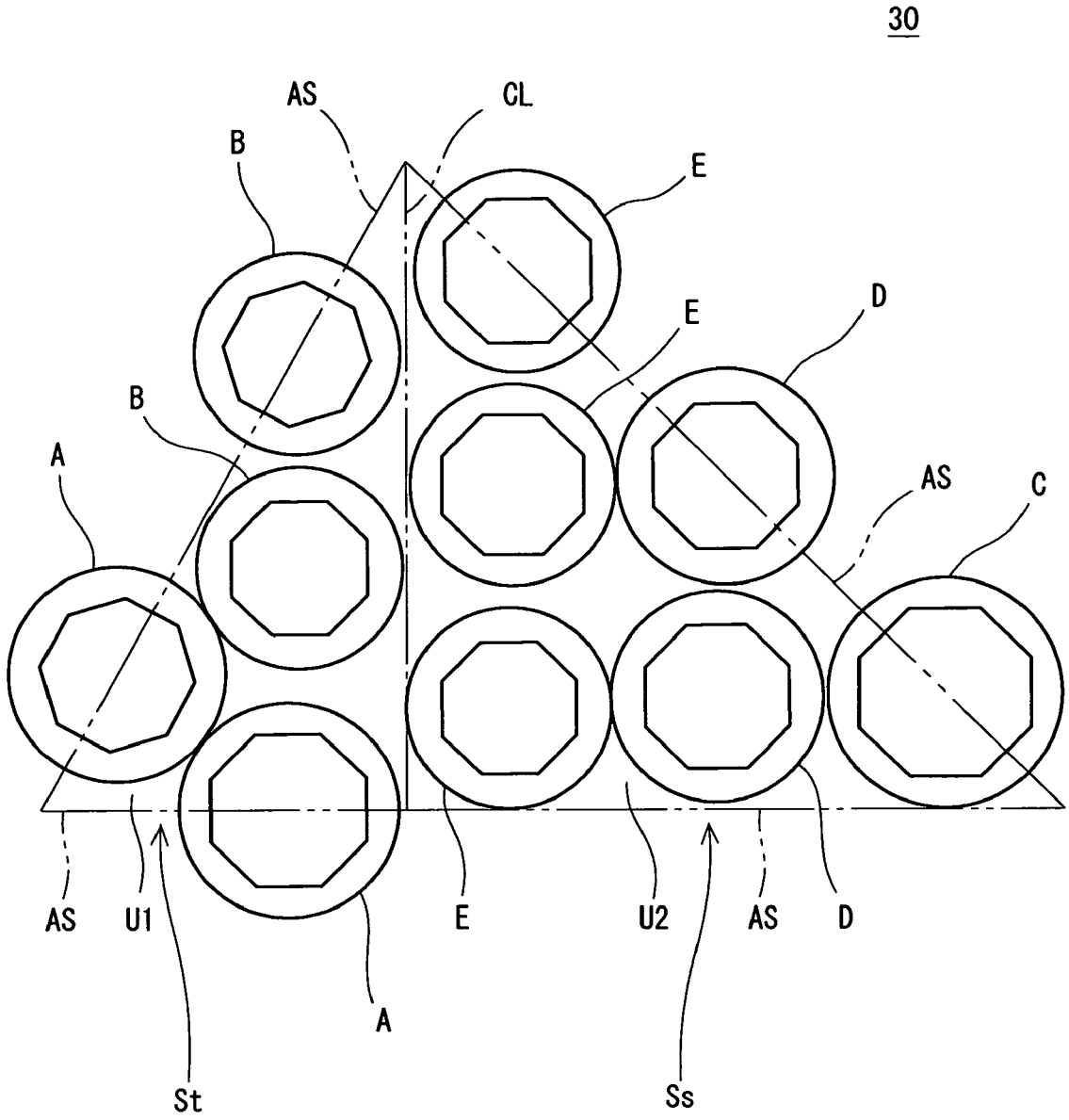
FIG. 9 is a development view illustrating a part of a golf ball according to yet another embodiment of the present invention.

FIG. 9 is a development view illustrating a part of a golf ball 30 according to yet another embodiment of the present invention. Also in this golf ball 30, dimples are arranged using a cuboctahedron similarly to the golf ball 2 shown in FIG. 2 and FIG. 3. Surface of the golf ball 30 is comparted into eight spherical regular triangles St and six spherical regular tetragons Ss by comparting lines CL. The spherical regular triangle St is comparted into six first units U1 by axes of symmetry AS. The spherical regular tetragon Ss is comparted into eight second units U2 by axes of symmetry AS. FIG. 9 shows one first unit U1 and one second unit U2.

The first unit U1 has dimples A and dimples B. The second unit U2 has dimples C, dimples D and dimples E. Any one of the dimples A to E is a two-tiered dimple having a first recessed part X (not shown in the Figure) and a second recessed part Y. Any one of the dimples A to E has a regular octagonal second opening. In other words, the second recessed part Y is a regular octangular pyramid. According to this golf ball 30, a great flight distance and excellent aerodynamic symmetry may be attained due to the two-tiered dimples.

EXAMPLES

Advantages of the present invention will be hereinafter demonstrated by way of Examples, however, the present invention should not be construed as being limited to the description of the Examples.

Example 1

A rubber composition was obtained by kneading 100 parts by weight of polybutadiene (trade name "BR-11", available from JSR Corporation), 24.5 parts by weight of zinc acrylate, 10 parts by weight of zinc oxide, 15 parts by weight of barium sulfate and 0.8 part by weight of dicumyl peroxide. This rubber composition was placed into a mold having upper and lower mold half each having a hemispherical cavity, and heated at 160° C. for 20 minutes to obtain a core having a diameter of 38.1 mm. On the other hand, a resin composition was obtained by kneading 50 parts by weight of an ionomer resin (trade name "Himilan 1605", available from Du Pont-MITSUI POLYCHEMICALS Co., Ltd.), 50 parts by weight of another ionomer resin (trade name "Himilan 1706", available from Du Pont-MITSUI POLYCHEMICALS Co., Ltd.) and 3 parts by weight of titanium dioxide. The aforementioned core was placed into a mold having numerous protrusions on the inner surface, followed by injection of the aforementioned resin composition around the core according to injection molding to form a cover having a thickness of 2.3 mm. Numerous dimples having a shape inverted from the shape of the protrusion were formed on the cover. Paint was applied on this cover to give a golf ball of Example 1 having a diameter of 42.7 mm and a weight of about 45.4 g. This golf ball had a compression of about 85, and a total volume of the dimples of about 320 $mm^3$. Specifications of the dimples of this golf ball are presented in Table 1 below.

Examples 2 to 10 and Comparative Examples 1 to 3

In a similar manner to Example 1 except that the mold was changed to alter specifications of the dimples as presented in Table 1 to Table 5 below, golf balls of Examples 2 to 10 and Comparative Examples 1 to 3 were obtained. In every golf ball, the dimples were arranged on the basis of a cuboctahedron. In the golf ball of Comparative Example 1, the dimples A to E have a cross-sectional shape showing single radius. In the golf ball of Comparative Example 2, the dimple A and the dimple B have a cross-sectional shape showing single radius. In the golf ball of Comparative Example 3, the dimple C, the dimple D and the dimple E have a cross-sectional shape showing single radius.

TABLE 1

| | Specification of dimples | | | | | | | | | | | | | | | | |
|---|---|---|---|---|---|---|---|---|---|---|---|---|---|---|---|---|---|
| | Kind | Number | D1 (mm) | d1 (mm) | D2 (mm) | Second opening | θ (deg.) | d2 (mm) | D3 (mm) | D4 (mm) | V2 ($mm^3$) | d (mm) | V ($mm^3$) | d2/d1 | D2/D1 | D3/D2 | P1 (%) |
| Example 1 (FIG. 4) | A | 48 | 4.30 | 0.080 | 2.88 | Regular triangle | 75 | 0.090 | 2.70 | 2.65 | 0.209 | 0.170 | 1.051 | 1.13 | 0.67 | 0.94 | 100 |
| | B | 72 | 3.90 | 0.080 | 2.60 | Regular triangle | 75 | 0.090 | 2.45 | 2.40 | 0.172 | 0.170 | 0.863 | 1.13 | 0.67 | 0.94 | |
| | C | 24 | 4.53 | 0.070 | 3.26 | Regular tetragon | 60 | 0.070 | 3.05 | 2.97 | 0.317 | 0.140 | 1.172 | 1.00 | 0.72 | 0.94 | |
| | D | 72 | 4.30 | 0.070 | 3.10 | Regular tetragon | 60 | 0.070 | 2.90 | 2.82 | 0.286 | 0.140 | 1.058 | 1.00 | 0.72 | 0.94 | |
| | E | 120 | 3.90 | 0.069 | 2.82 | Regular tetragon | 60 | 0.070 | 2.60 | 2.52 | 0.229 | 0.139 | 0.857 | 1.01 | 0.72 | 0.92 | |
| Example 2 (FIG. 7) | A | 48 | 4.30 | 0.070 | 3.10 | Regular tetragon | 60 | 0.070 | 2.90 | 2.82 | 0.286 | 0.140 | 1.058 | 1.00 | 0.72 | 0.94 | 100 |
| | B | 72 | 3.90 | 0.069 | 2.82 | Regular tetragon | 60 | 0.070 | 2.60 | 2.52 | 0.229 | 0.139 | 0.857 | 1.01 | 0.72 | 0.92 | |
| | C | 24 | 4.53 | 0.070 | 3.26 | Regular tetragon | 60 | 0.070 | 3.05 | 2.97 | 0.317 | 0.140 | 1.172 | 1.00 | 0.72 | 0.94 | |
| | D | 72 | 4.30 | 0.070 | 3.10 | Regular tetragon | 60 | 0.070 | 2.90 | 2.82 | 0.286 | 0.140 | 1.058 | 1.00 | 0.72 | 0.94 | |
| | E | 120 | 3.90 | 0.069 | 2.82 | Regular tetragon | 60 | 0.070 | 2.60 | 2.52 | 0.229 | 0.139 | 0.857 | 1.01 | 0.72 | 0.92 | |
| Example 3 (FIG. 8) | A | 48 | 4.30 | 0.069 | 3.12 | Regular pentagon | 60 | 0.060 | 2.90 | 2.83 | 0.293 | 0.129 | 1.057 | 0.87 | 0.72 | 0.93 | 100 |
| | B | 72 | 3.90 | 0.068 | 2.84 | Regular pentagon | 60 | 0.060 | 2.60 | 2.53 | 0.235 | 0.128 | 0.856 | 0.88 | 0.73 | 0.92 | |
| | C | 24 | 4.53 | 0.070 | 3.26 | Regular pentagon | 60 | 0.060 | 3.05 | 2.98 | 0.324 | 0.130 | 1.179 | 0.86 | 0.72 | 0.94 | |
| | D | 72 | 4.30 | 0.069 | 3.12 | Regular pentagon | 60 | 0.060 | 2.90 | 2.83 | 0.293 | 0.129 | 1.057 | 0.87 | 0.72 | 0.93 | |
| | E | 120 | 3.90 | 0.068 | 2.84 | Regular pentagon | 60 | 0.060 | 2.60 | 2.53 | 0.235 | 0.128 | 0.856 | 0.88 | 0.73 | 0.92 | |

TABLE 2

| | Specification of dimples | | | | | | | | | | | | | | | | |
|---|---|---|---|---|---|---|---|---|---|---|---|---|---|---|---|---|---|
| | Kind | Number | D1 (mm) | d1 (mm) | D2 (mm) | Second opening | θ (deg.) | d2 (mm) | D3 (mm) | D4 (mm) | V2 ($mm^3$) | d (mm) | V ($mm^3$) | d2/d1 | D2/D1 | D3/D2 | P1 (%) |
| Example 4 (FIG. 9) | A | 48 | 4.30 | 0.065 | 3.20 | Regular octagon | 60 | 0.060 | 2.90 | 2.83 | 0.348 | 0.125 | 1.081 | 0.92 | 0.74 | 0.91 | 100 |
| | B | 72 | 3.90 | 0.059 | 3.00 | Regular octagon | 60 | 0.060 | 2.60 | 2.53 | 0.279 | 0.119 | 0.840 | 1.02 | 0.77 | 0.87 | |
| | C | 24 | 4.53 | 0.068 | 3.30 | Regular octagon | 60 | 0.060 | 3.05 | 2.98 | 0.386 | 0.128 | 1.224 | 0.88 | 0.73 | 0.92 | |
| | D | 72 | 4.30 | 0.065 | 3.20 | Regular octagon | 60 | 0.060 | 2.90 | 2.83 | 0.348 | 0.125 | 1.081 | 0.92 | 0.74 | 0.91 | |
| | E | 120 | 3.90 | 0.059 | 3.00 | Regular octagon | 60 | 0.060 | 2.60 | 2.53 | 0.279 | 0.119 | 0.840 | 1.02 | 0.77 | 0.87 | |
| Example 5 (FIG. 4) | A | 48 | 4.30 | 0.090 | 2.65 | Regular triangle | 75 | 0.115 | 1.95 | 1.89 | 0.138 | 0.205 | 1.040 | 1.28 | 0.62 | 0.74 | 100 |
| | B | 72 | 3.90 | 0.080 | 2.60 | Regular triangle | 75 | 0.115 | 1.75 | 1.69 | 0.110 | 0.195 | 0.802 | 1.44 | 0.67 | 0.67 | |
| | C | 24 | 4.53 | 0.090 | 2.79 | Regular tetragon | 60 | 0.115 | 2.20 | 2.07 | 0.262 | 0.205 | 1.261 | 1.28 | 0.62 | 0.79 | |
| | D | 72 | 4.30 | 0.090 | 2.65 | Regular tetragon | 60 | 0.115 | 1.95 | 1.82 | 0.204 | 0.205 | 1.107 | 1.28 | 0.62 | 0.74 | |
| | E | 120 | 3.90 | 0.080 | 2.60 | Regular tetragon | 60 | 0.115 | 1.75 | 1.62 | 0.163 | 0.195 | 0.854 | 1.44 | 0.67 | 0.67 | |
| Example 6 (FIG. 4) | A | 48 | 4.30 | 0.080 | 2.88 | Regular triangle | 20 | 0.090 | 2.70 | 2.21 | 0.176 | 0.170 | 1.019 | 1.13 | 0.67 | 0.94 | 100 |
| | B | 72 | 3.90 | 0.080 | 2.60 | Regular triangle | 20 | 0.085 | 2.45 | 1.98 | 0.136 | 0.165 | 0.827 | 1.06 | 0.67 | 0.94 | |
| | C | 24 | 4.53 | 0.070 | 3.26 | Regular tetragon | 20 | 0.090 | 3.05 | 2.56 | 0.354 | 0.160 | 1.209 | 1.29 | 0.72 | 0.94 | |
| | D | 72 | 4.30 | 0.070 | 3.10 | Regular tetragon | 20 | 0.090 | 2.90 | 2.41 | 0.318 | 0.160 | 1.090 | 1.29 | 0.72 | 0.94 | |
| | E | 120 | 3.90 | 0.069 | 2.82 | Regular tetragon | 20 | 0.085 | 2.60 | 2.13 | 0.239 | 0.154 | 0.866 | 1.23 | 0.72 | 0.92 | |

TABLE 3

| | Specification of dimples | | | | | | | | | | | | | | | | |
|---|---|---|---|---|---|---|---|---|---|---|---|---|---|---|---|---|---|
| | Kind | Number | D1 (mm) | d1 (mm) | D2 (mm) | Second opening | θ (deg.) | d2 (mm) | D3 (mm) | D4 (mm) | V2 ($mm^3$) | d (mm) | V ($mm^3$) | d2/d1 | D2/D1 | D3/D2 | P1 (%) |
| Example 7 (FIG. 4) | A | 48 | 4.30 | 0.092 | 2.60 | Regular triangle | 75 | 0.057 | 2.40 | 2.37 | 0.105 | 0.149 | 1.019 | 0.62 | 0.61 | 0.92 | 100 |
| | B | 72 | 3.90 | 0.090 | 2.39 | Regular triangle | 75 | 0.056 | 2.25 | 2.22 | 0.091 | 0.146 | 0.831 | 0.62 | 0.61 | 0.94 | |
| | C | 24 | 4.53 | 0.095 | 2.66 | Regular tetragon | 60 | 0.057 | 2.50 | 2.43 | 0.173 | 0.152 | 1.202 | 0.60 | 0.59 | 0.94 | |
| | D | 72 | 4.30 | 0.092 | 2.60 | Regular tetragon | 60 | 0.057 | 2.40 | 2.33 | 0.160 | 0.149 | 1.073 | 0.62 | 0.61 | 0.92 | |
| | E | 120 | 3.90 | 0.090 | 2.39 | Regular tetragon | 60 | 0.056 | 2.25 | 2.19 | 0.138 | 0.146 | 0.878 | 0.62 | 0.61 | 0.94 | |
| Example 8 (FIG. 4) | A | 48 | 4.30 | 0.060 | 3.30 | Regular triangle | 75 | 0.110 | 2.90 | 2.84 | 0.294 | 0.170 | 0.986 | 1.83 | 0.77 | 0.88 | 100 |
| | B | 72 | 3.90 | 0.060 | 2.98 | Regular triangle | 75 | 0.110 | 2.60 | 2.54 | 0.236 | 0.170 | 0.804 | 1.83 | 0.76 | 0.87 | |
| | C | 24 | 4.53 | 0.060 | 3.47 | Regular tetragon | 60 | 0.100 | 3.05 | 2.93 | 0.448 | 0.160 | 1.214 | 1.67 | 0.77 | 0.88 | |
| | D | 72 | 4.30 | 0.060 | 3.30 | Regular tetragon | 60 | 0.100 | 2.90 | 2.78 | 0.404 | 0.160 | 1.096 | 1.67 | 0.77 | 0.88 | |
| | E | 120 | 3.90 | 0.060 | 2.98 | Regular tetragon | 60 | 0.100 | 2.60 | 2.48 | 0.323 | 0.160 | 0.891 | 1.67 | 0.76 | 0.87 | |
| Example 9 (FIG. 4) | A | 48 | 4.30 | 0.120 | 1.79 | Regular triangle | 75 | 0.030 | 1.60 | 1.58 | 0.025 | 0.150 | 1.048 | 0.25 | 0.42 | 0.89 | 100 |
| | B | 72 | 3.90 | 0.120 | 1.60 | Regular triangle | 75 | 0.030 | 1.40 | 1.38 | 0.019 | 0.150 | 0.857 | 0.25 | 0.41 | 0.88 | |
| | C | 24 | 4.53 | 0.120 | 1.88 | Regular tetragon | 60 | 0.030 | 1.70 | 1.67 | 0.042 | 0.150 | 1.175 | 0.25 | 0.42 | 0.90 | |
| | D | 72 | 4.30 | 0.120 | 1.79 | Regular tetragon | 60 | 0.030 | 1.60 | 1.57 | 0.038 | 0.150 | 1.061 | 0.25 | 0.42 | 0.89 | |
| | E | 120 | 3.90 | 0.120 | 1.60 | Regular tetragon | 60 | 0.030 | 1.40 | 1.37 | 0.029 | 0.150 | 0.866 | 0.25 | 0.41 | 0.88 | |

TABLE 4

Figure 10:
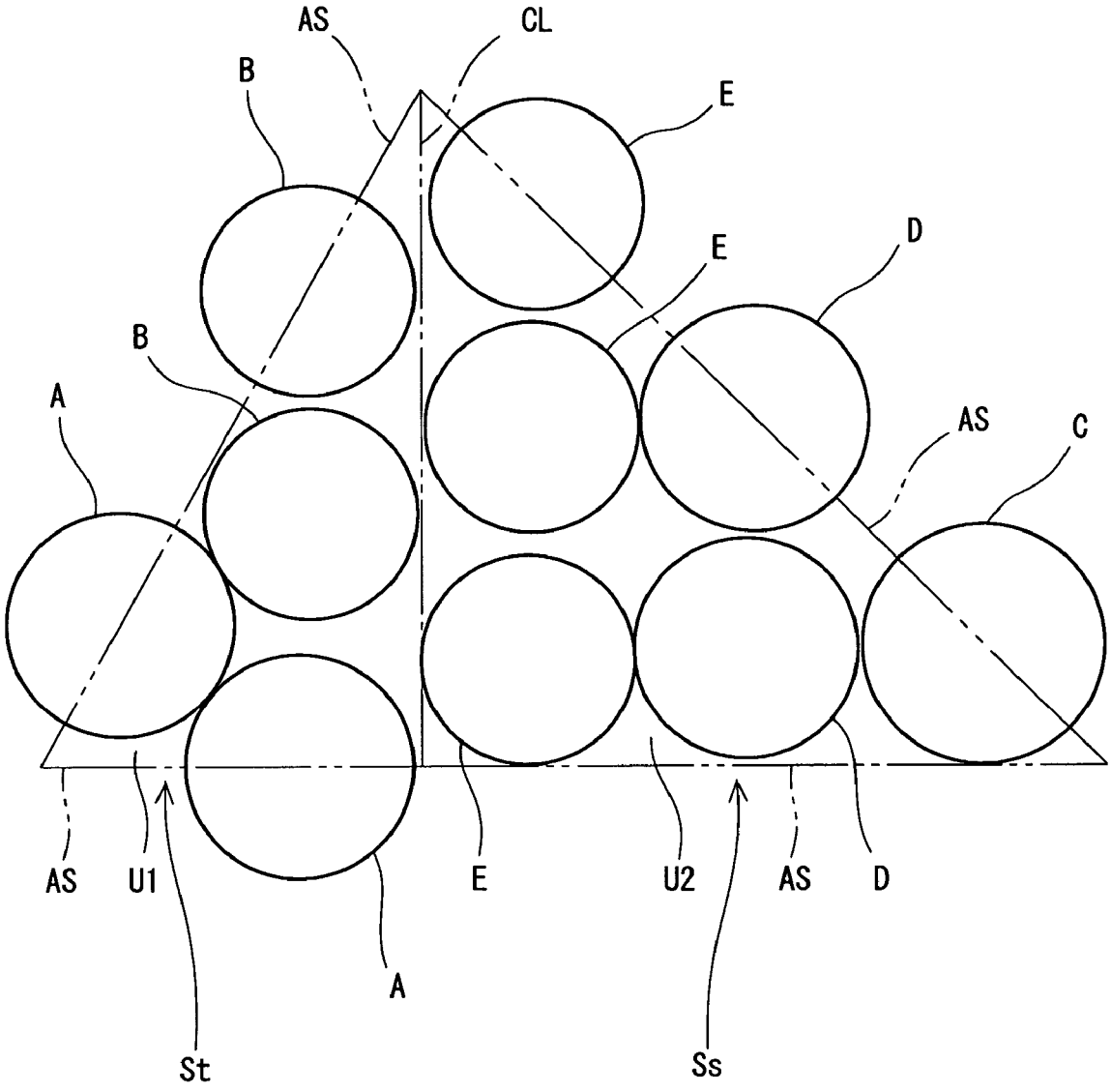
FIG. 10 is a development view illustrating a part of a golf ball according to Comparative Example.

| | Specification of dimples | | | | | | | | | | | | | | | | |
|---|---|---|---|---|---|---|---|---|---|---|---|---|---|---|---|---|---|
| | Kind | Number | D1 (mm) | d1 (mm) | D2 (mm) | Second opening | θ (deg.) | d2 (mm) | D3 (mm) | D4 (mm) | V2 ($mm^3$) | d (mm) | V ($mm^3$) | d2/d1 | D2/D1 | D3/D2 | P1 (%) |
| Example 10 (FIG. 4) | A | 48 | 4.30 | 0.030 | 3.83 | Regular triangle | 75 | 0.120 | 3.60 | 3.54 | 0.496 | 0.150 | 0.887 | 4.00 | 0.89 | 0.94 | 100 |
| | B | 72 | 3.90 | 0.030 | 3.47 | Regular triangle | 75 | 0.120 | 3.20 | 3.14 | 0.391 | 0.150 | 0.712 | 4.00 | 0.89 | 0.92 | |
| | C | 24 | 4.53 | 0.030 | 4.03 | Regular tetragon | 60 | 0,150 | 3.80 | 3.63 | 1.034 | 0.180 | 1.467 | 5.00 | 0.89 | 0.94 | |
| | D | 72 | 4.30 | 0.030 | 3.83 | Regular tetragon | 60 | 0.120 | 3.60 | 3.46 | 0.748 | 0.150 | 1.139 | 4.00 | 0.89 | 0.94 | |
| | E | 120 | 3.90 | 0.030 | 3.47 | Regular tetragon | 60 | 0.120 | 3.20 | 3.06 | 0.588 | 0.150 | 0.909 | 4.00 | 0.89 | 0.92 | |
| Comp. Example 1 (FIG. 10) | A | 48 | 4.30 | — | — | — | — | — | — | — | — | 0.145 | 1.054 | — | — | — | 0 |
| | B | 72 | 3.90 | — | — | — | — | — | — | — | — | 0.144 | 0.862 | — | — | — | |
| | C | 24 | 4.53 | — | — | — | — | — | — | — | — | 0.145 | 1.168 | — | — | — | |
| | D | 72 | 4.30 | — | — | — | — | — | — | — | — | 0.145 | 1.054 | — | — | — | |
| | E | 120 | 3.90 | — | — | — | — | — | — | — | — | 0.144 | 0.862 | — | — | — | |

TABLE 5

Figure 11:
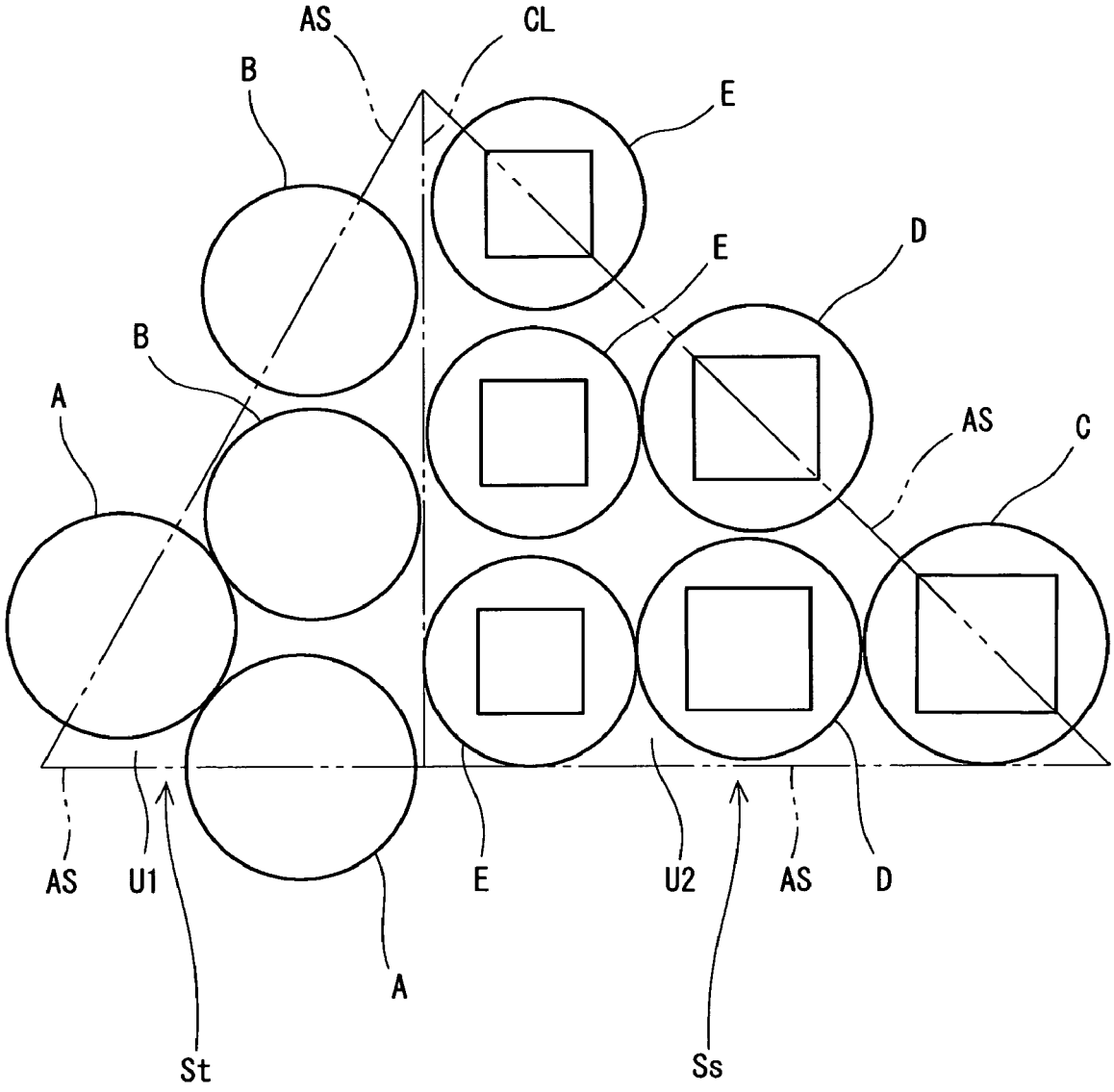
FIG. 11 is a development view illustrating a part of a golf ball according to Comparative Example.

| | Specification of dimples | | | | | | | | | | | | | | | | |
|---|---|---|---|---|---|---|---|---|---|---|---|---|---|---|---|---|---|
| | Kind | Number | D1 (mm) | d1 (mm) | D2 (mm) | Second opening | θ (deg.) | d2 (mm) | D3 (mm) | D4 (mm) | V2 ($mm^3$) | d (mm) | V ($mm^3$) | d2/d1 | D2/D1 | D3/D2 | P1 (%) |
| Comp. Example 2 (FIG. 11) | A | 48 | 4.30 | — | — | — | — | — | — | — | — | 0.145 | 1.054 | — | — | — | 64 |
| | B | 72 | 3.90 | — | — | — | — | — | — | — | — | 0.144 | 0.862 | — | — | — | |
| | C | 24 | 4.53 | 0.070 | 3.26 | Regular tetragon | 60 | 0.070 | 3.05 | 2.97 | 0.317 | 0.140 | 1.172 | 1.00 | 0.72 | 0.94 | |
| | D | 72 | 4.30 | 0.070 | 3.10 | Regular tetragon | 60 | 0.070 | 2.90 | 2.82 | 0.286 | 0.140 | 1.058 | 1.00 | 0.72 | 0.94 | |
| | E | 120 | 3.90 | 0.069 | 2.82 | Regular tetragon | 60 | 0.070 | 2.60 | 2.52 | 0.229 | 0.139 | 0.857 | 1.01 | 0.72 | 0.92 | |

TABLE 5-continued

Figure 12:
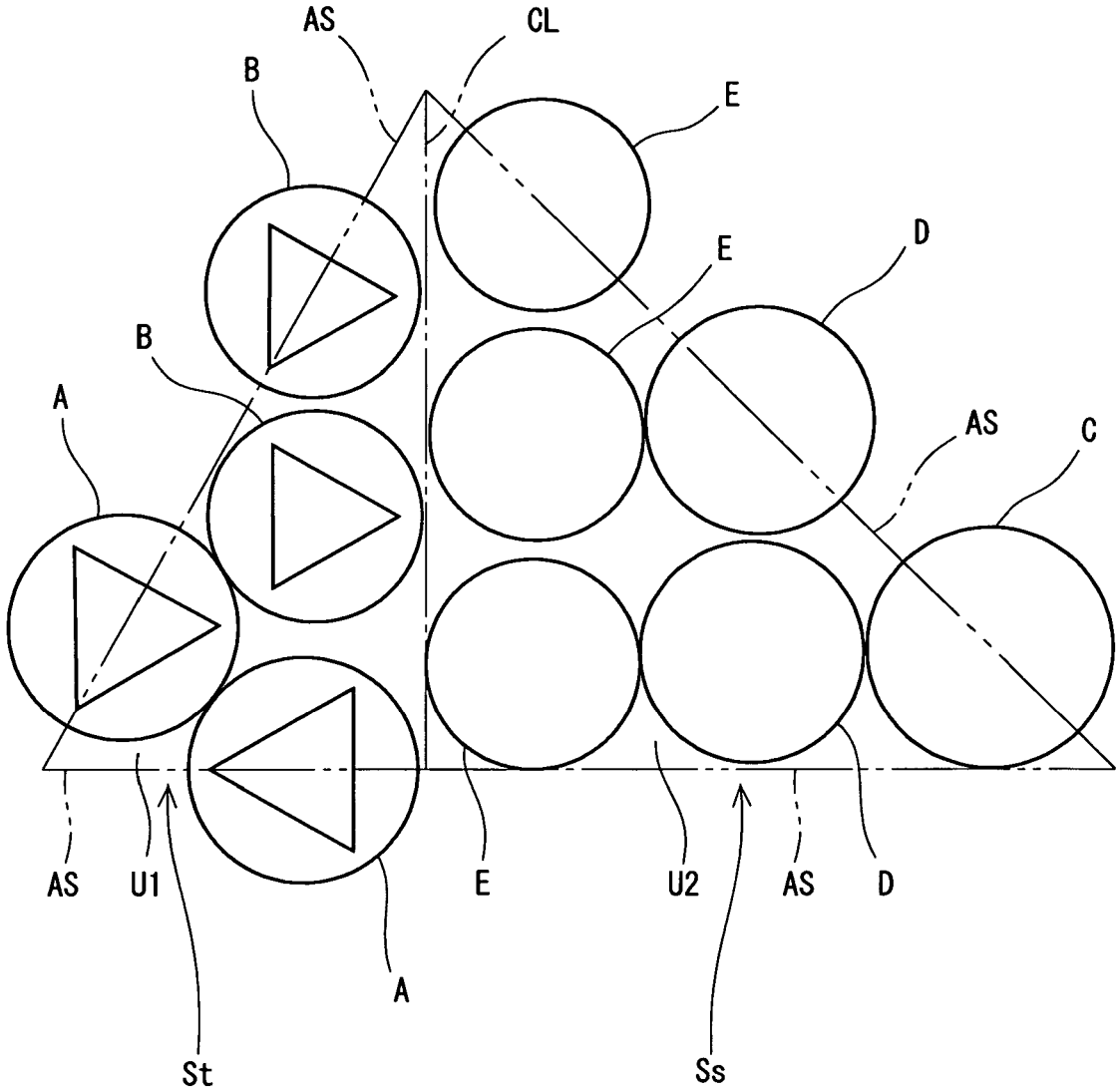
FIG. 12 is a development view illustrating a part of a golf ball according to Comparative Example.

| | Specification of dimples | | | | | | | | | | | | | | | | |
|---|---|---|---|---|---|---|---|---|---|---|---|---|---|---|---|---|---|
| | Kind | Number | D1 (mm) | d1 (mm) | D2 (mm) | Second opening | θ (deg.) | d2 (mm) | D3 (mm) | D4 (mm) | V2 ($mm^3$) | d (mm) | V ($mm^3$) | d2/d1 | D2/D1 | D3/D2 | P1 (%) |
| Comp. Example 3 (FIG. 12) | A | 48 | 4.30 | 0.080 | 2.88 | Regular triangle | 75 | 0.090 | 2.70 | 2.65 | 0.209 | 0.170 | 1.051 | 1.13 | 0.67 | 0.94 | 36 |
| | B | 72 | 3.90 | 0.080 | 2.60 | Regular triangle | 75 | 0.090 | 2.45 | 2.40 | 0.172 | 0.170 | 0.863 | 1.13 | 0.67 | 0.94 | |
| | C | 24 | 4.53 | — | — | — | — | — | — | — | — | 0.145 | 1.168 | — | — | — | |
| | D | 72 | 4.30 | — | — | — | — | — | — | — | — | 0.145 | 1.054 | — | — | — | |
| | E | 120 | 3.90 | — | — | — | — | — | — | — | — | 0.144 | 0.862 | — | — | — | |

[Travel Distance Test]

A driver having a metal head (trade name "XXIO", available from Sumitomo Rubber Industries, Ltd.; shaft hardness: X, loft angle: 9°) was attached to a swing machine, available from True Temper Co. Then the golf ball was hit under the condition to provide a head speed of 49 m/sec, the launch angle being approximately 11° and giving the initial spin rate of approximately 3000 rpm. Accordingly, the distance from the launching point to the point where the ball stopped was measured. Mean values of 20 times measurement upon pole shot and seam shot, respectively, are shown in Table 6 below.

TABLE 6

| | Travel distance | | | | | | | | | | | | |
|---|---|---|---|---|---|---|---|---|---|---|---|---|---|
| | Example 1 | Example 2 | Example 3 | Example 4 | Example 5 | Example 6 | Example 7 | Example 8 | Example 9 | Example 10 | Comp. Example 1 | Comp. Example 2 | Comp. Example 3 |
| Pole shot (m) | 236.0 | 235.1 | 234.6 | 232.2 | 233.5 | 233.1 | 233.5 | 233.8 | 232.9 | 233.4 | 229.6 | 231.8 | 231.1 |
| Seam shot (m) | 235.2 | 234.1 | 233.4 | 231.2 | 232.3 | 232.0 | 232.4 | 232.6 | 232.0 | 232.0 | 229.0 | 229.9 | 229.0 |
| Difference (m) | 0.8 | 1.0 | 1.2 | 1.0 | 1.2 | 1.1 | 1.1 | 1.2 | 0.9 | 1.4 | 0.6 | 1.9 | 2.1 |

As shown in Table 6, a great flight distance is attained by the golf balls of Examples. Also, small difference between the flight distance of the pole shot and that of the seam shot was found. Therefore, advantages of the present invention are clearly suggested by these results of evaluation.

The present invention is applicable to not only two-piece golf balls, but also one-piece golf balls, multi-piece golf balls and wound golf balls. The foregoing description is just for an illustrative example, therefore, various modifications can be made in the scope without departing from the principles of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A golf ball having numerous dimples on the surface thereof, said dimples including two-tiered dimples, a proportion of the number of the two-tiered dimples to a total number of the dimples being equal to or greater than 70%, said two-tiered dimples having a first recessed part and a second recessed part, said first recessed part comprising a circular first opening positioned on a phantom spherical surface, a side wall curved face positioned on the inside of said first opening, and a flat face positioned on the inside of said side wall curved face, said second recessed part comprising a polygonal second opening positioned on the flat face, a slope positioned on the inside of said second opening, and a bottom face positioned on the inside of said slope.

2. The golf ball according to claim 1, wherein when said phantom spherical surface is comparted into multiple spherical regular polygons by comparting lines formed through casting a reflection of sides of a regular polyhedron or a quasi-regular polyhedron, which is inscribed in said phantom spherical surface, onto said phantom spherical surface, dimples comprising a second opening having a number of vertices equal to the number of vertices of said spherical regular polygon are predominantly formed on each spherical regular polygon.

3. The golf ball according to claim 1, wherein a direction of the axis of symmetry or the comparting line of said spherical regular polygon agrees with the direction of the axis of symmetry of the second opening of the dimple included in said spherical regular polygon.

4. The golf ball according to claim 1, wherein when said phantom spherical surface is comparted into eight spherical regular triangles and six spherical regular tetragons by comparting lines formed through casting a reflection of sides of a cuboctahedron, which is inscribed in said phantom spherical surface, onto said phantom spherical surface, dimples having a triangular second opening are predominantly formed on said spherical regular triangle, while dimples having a tetragonal second opening are predominantly formed on said spherical regular tetragon.

* * * * *